US007935028B2

(12) United States Patent
Ketomäki

(10) Patent No.: US 7,935,028 B2
(45) Date of Patent: May 3, 2011

(54) EXERCISE DEVICE AND ITS ARM REST

(75) Inventor: Ismo Ketomäki, Paalijärvi (FI)

(73) Assignee: Accell Fitness Division B.V., Almere (NL)

( * ) Notice: Subject to any disclaimer, the term of this patent is extended or adjusted under 35 U.S.C. 154(b) by 195 days.

(21) Appl. No.: 12/068,326

(22) Filed: Feb. 5, 2008

(65) Prior Publication Data

US 2009/0156368 A1 Jun. 18, 2009

(30) Foreign Application Priority Data

Dec. 12, 2007 (FI) ..... 20075899

(51) Int. Cl.
*A63B 21/00* (2006.01)
*A63B 22/04* (2006.01)

(52) U.S. Cl. ..... 482/52; 482/62; 482/139

(58) Field of Classification Search ..... 482/51–53, 482/57, 62, 148, 137–139
See application file for complete search history.

(56) References Cited

U.S. PATENT DOCUMENTS

| | | | | |
|---|---|---|---|---|
| 4,961,569 | A * | 10/1990 | Roberge | 482/62 |
| 5,265,307 | A * | 11/1993 | Hull et al. | 16/406 |
| 5,399,133 | A * | 3/1995 | Haber et al. | 482/49 |
| 6,394,936 | B1 | 5/2002 | Voris | |
| 6,471,624 | B1 | 10/2002 | Voris | |
| 7,108,641 | B2 * | 9/2006 | Pertegaz-Esteban | 482/139 |
| 2005/0107219 | A1 | 5/2005 | Miller | |
| 2009/0048073 | A1 * | 2/2009 | Roimicher et al. | 482/52 |

FOREIGN PATENT DOCUMENTS

| | | | |
|---|---|---|---|
| DE | 203 19 128 | U1 | 3/2004 |
| EP | 1 700 622 | A1 | 9/2006 |
| GB | 2373741 | A | 10/2002 |

* cited by examiner

*Primary Examiner* — Steve R Crow
(74) *Attorney, Agent, or Firm* — Birch, Stewart, Kolasch & Birch, LLP

(57) ABSTRACT

An armrest for an exercise device which is arranged to be attached to a frame structure of the exercise device. The armrest is provided with a separate moving handle which is arranged to move in at least one direction with respect to the armrest during exercise.

9 Claims, 6 Drawing Sheets

EXERCISE DEVICE AND ITS ARM REST

The invention relates to an armrest for an exercise device, the armrest being arranged to be attached to a frame structure of the exercise device. The invention further relates to an exercise device comprising a frame structure and at least one armrest arranged to be supported by the frame structure.

Various armrests are nowadays well-known in different exercise devices. Examples of exercise devices provided with various moving armrests include crosstrainers. In crosstrainers, the armrest is conventionally a part made of an elongated and tubular element whose upper end the user grasps when using the device. A typical example of the above-mentioned crosstrainers is a crosstrainer sold under model name Tunturi C60.

In the field, it is also known to use armrests provided with various handles that stay in a fixed position during exercise, i.e. various gripping options by means of the shape or parts of the armrest. Embodiments of these solutions allow changing the grip before starting an exercise as required by the exercise. The grip, however, remains the same during the whole exercise. Examples of such solutions include solutions known from U.S. Pat. Nos. 4,961,569 and 5,094,124, US application 2007/0117683 and British application 2 373 741.

A drawback of prior art solutions is that they do not provide wide options for three-dimensional trajectories of the wrist and of the whole upper body, in which case the effect of exercises is not optimal.

The object of the invention is to provide an armrest for an exercise device and an exercise device to eliminate the drawbacks of prior art. This is achieved by an armrest for an exercise device and an exercise device according to the invention. The exercise device armrest according to the invention is characterized in that the armrest is provided with a separate moving handle which is arranged to move at least in one direction with respect to the armrest during exercise. The exercise device according to the invention is characterized in that the armrest is provided with a separate handle which is arranged to move in at least one direction with respect to the armrest during exercise.

A major advantage of the invention is that the separate moving handle enables three-dimensional trajectories for the user's wrist and thus for the whole upper body during exercise that were unachievable in connection with prior art exercise devices. Thus the invention provides more effective and diverse exercises than prior art exercise devices. A further advantage of the invention is its simplicity, which makes introduction of the device inexpensive.

Figure 1:
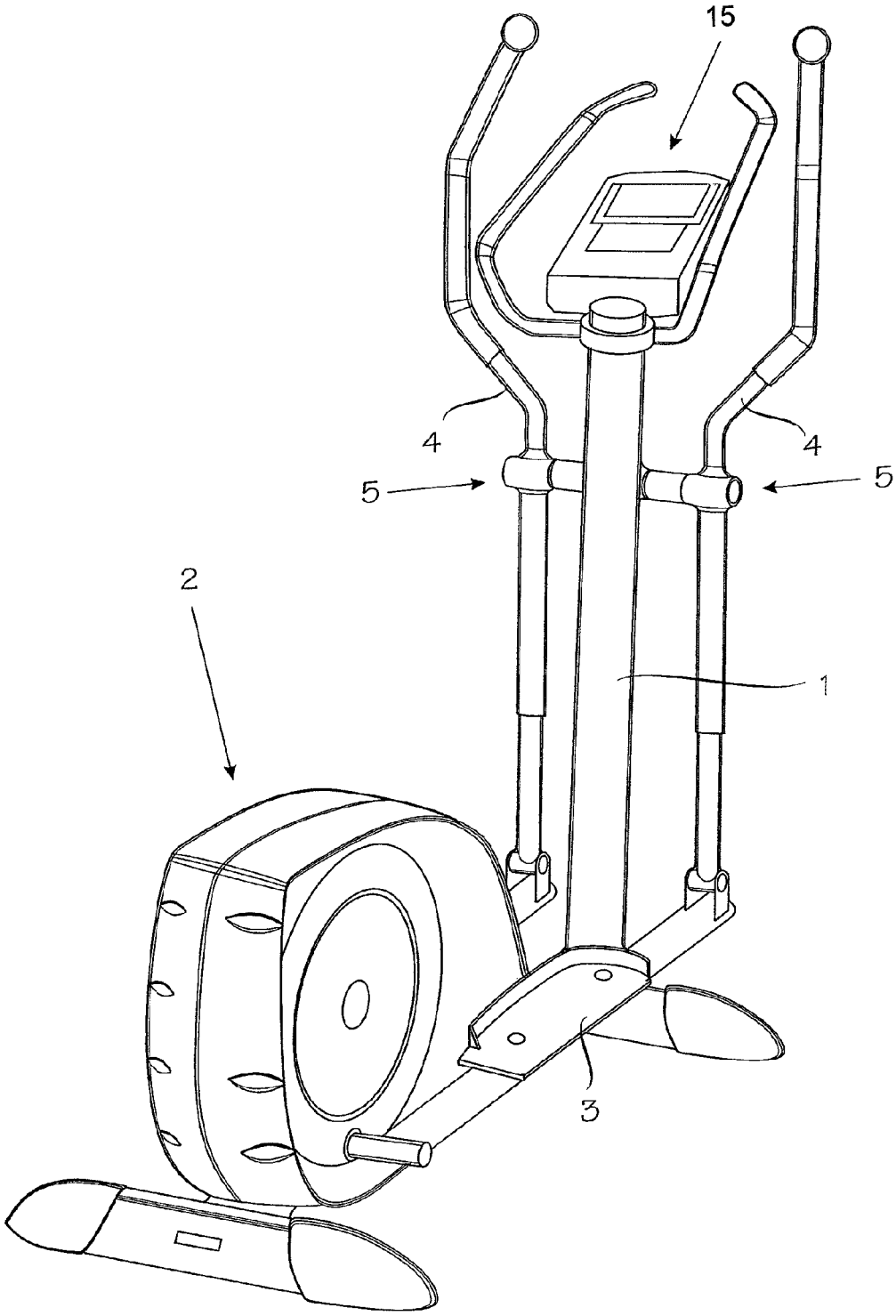
Fig. 1 PRIOR ART
Figure 2A:
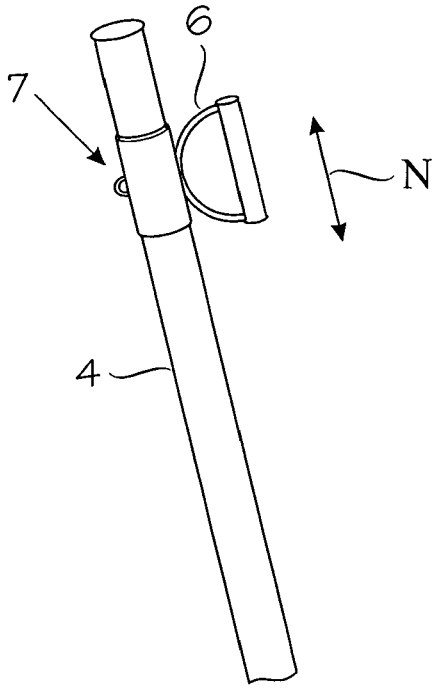
Figure 2B:
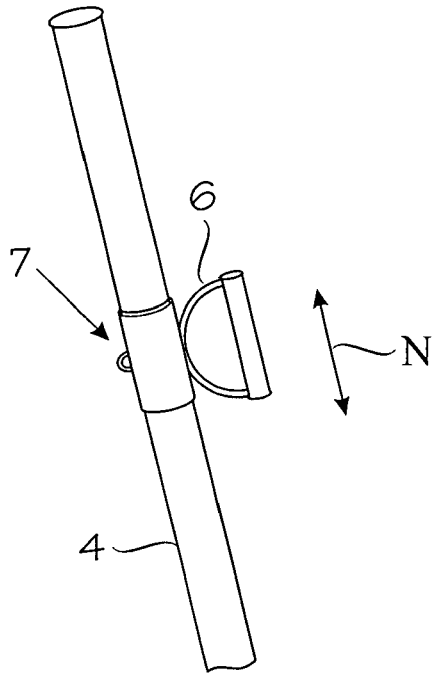
Figure 3A:
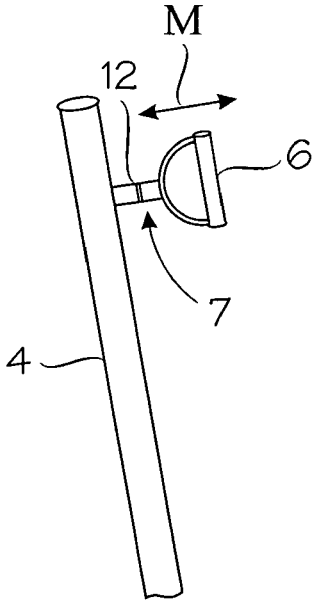
Figure 3B:
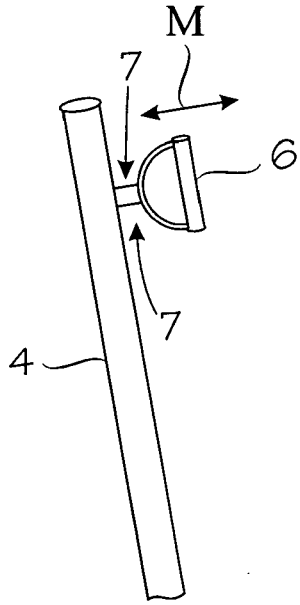
Figure 4A:
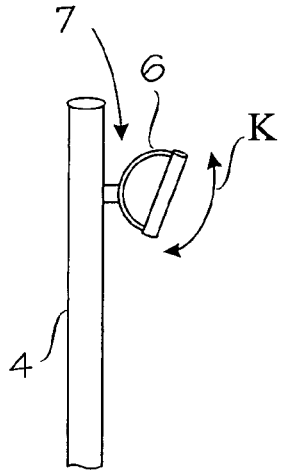
Figure 4B:
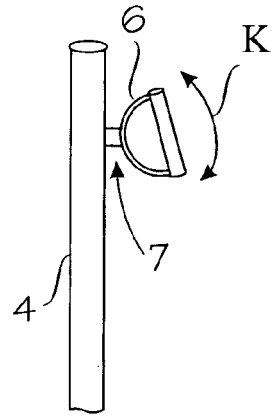
Figure 5A:
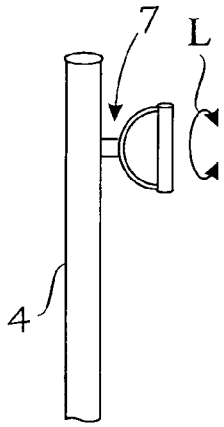
Figure 5B:
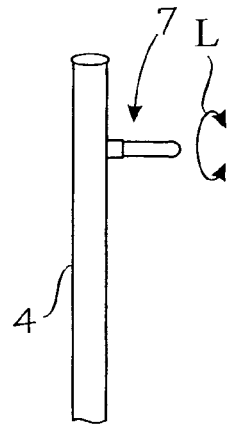
Figure 6:
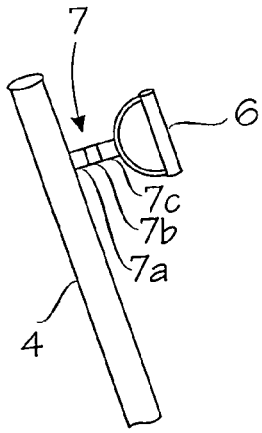
Figure 7:
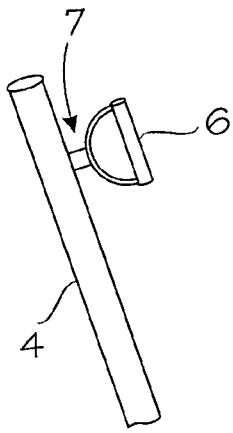
Figure 8:
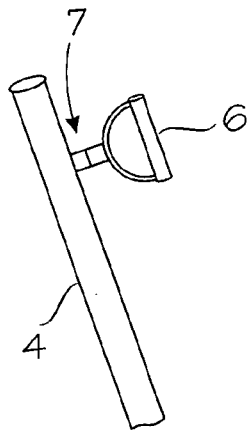
Figure 9A:
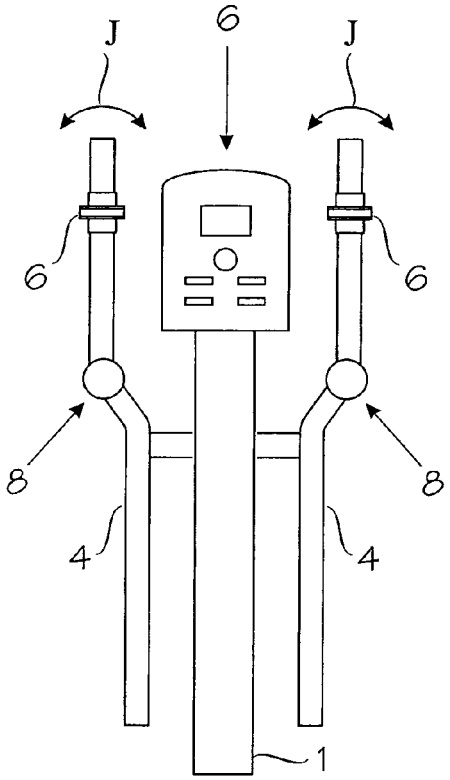
Figure 9B:
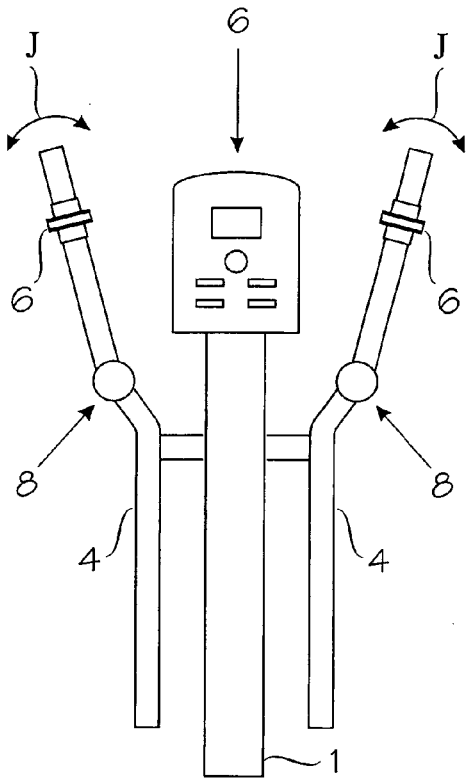
Figure 10A:
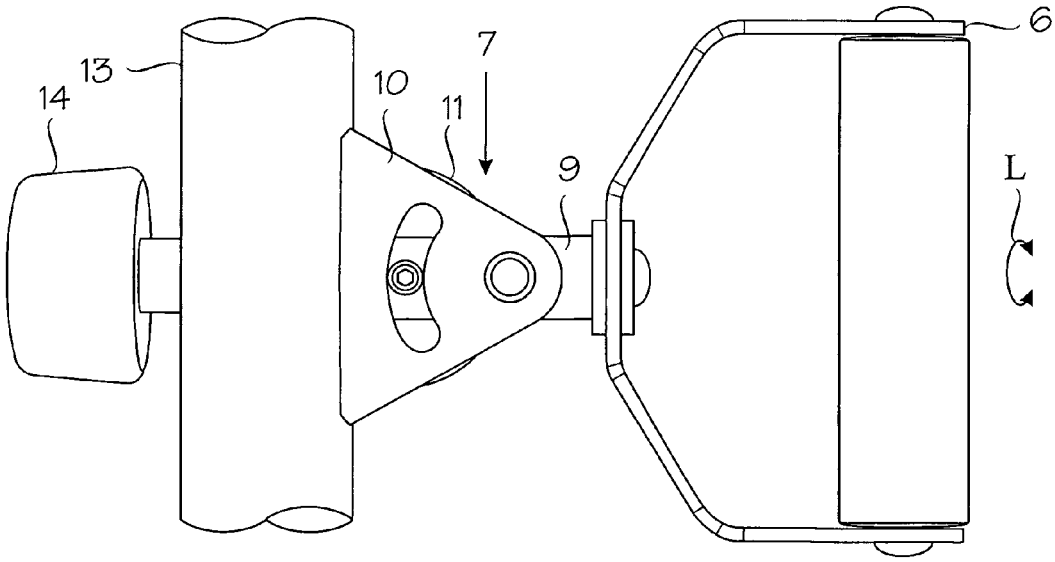
Figure 10B:
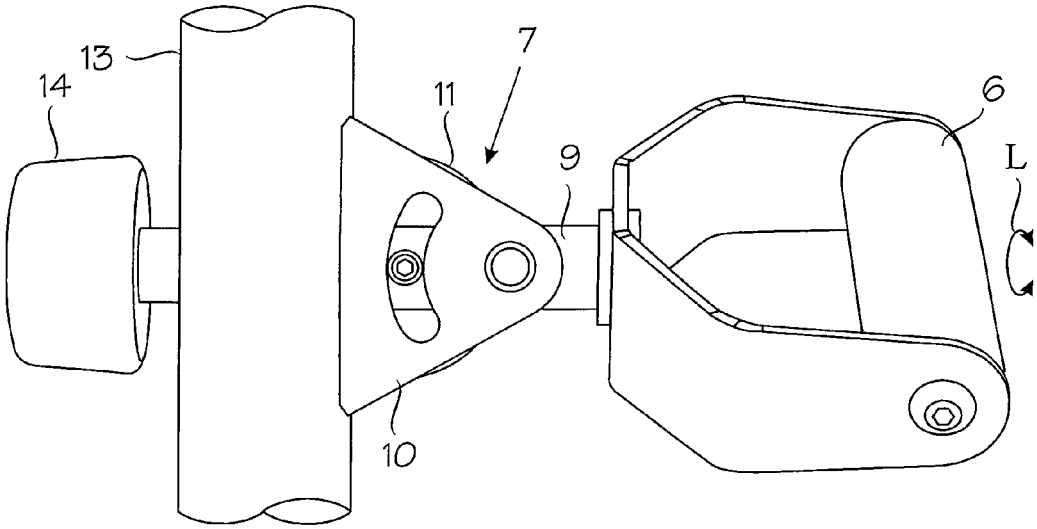
Figure 11A:
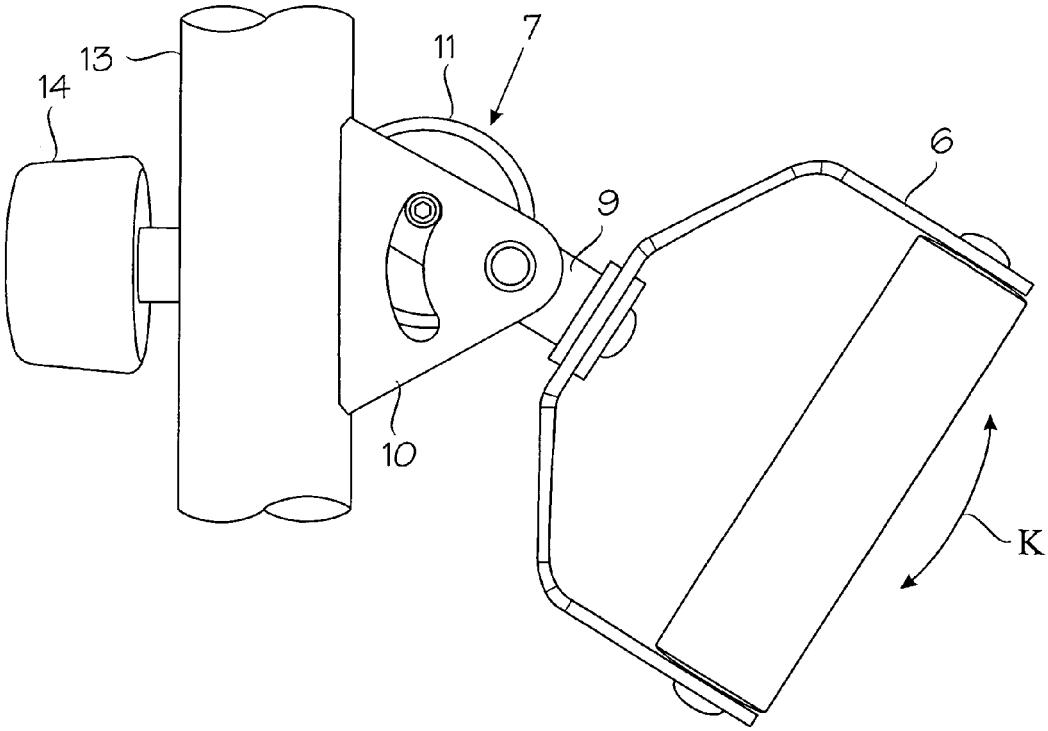
Figure 11B:
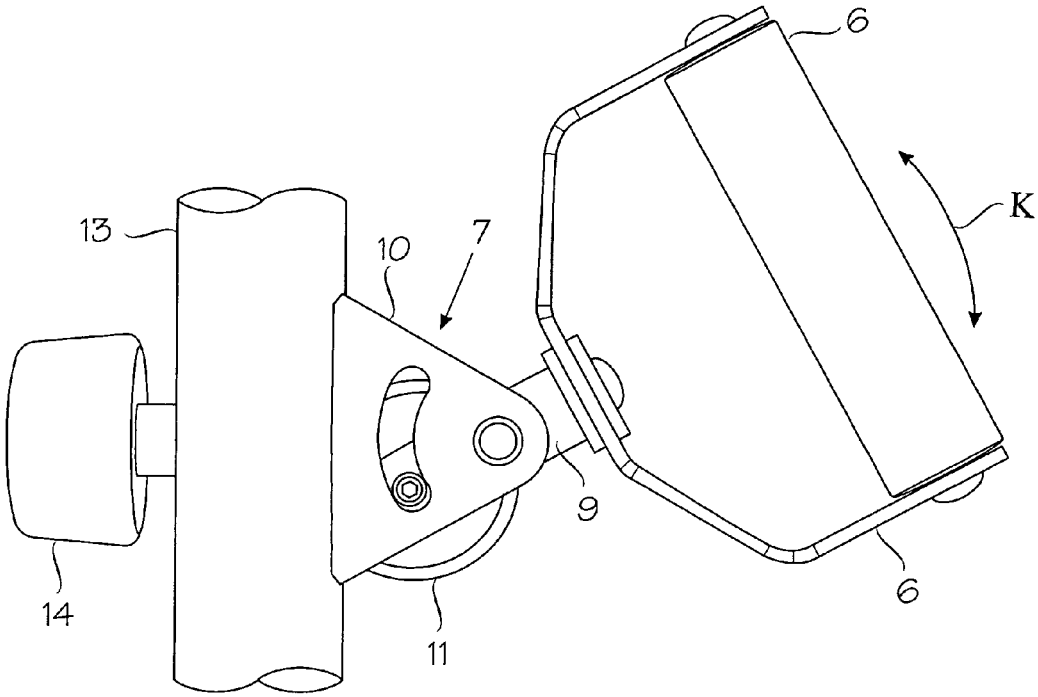
Figure 11C:
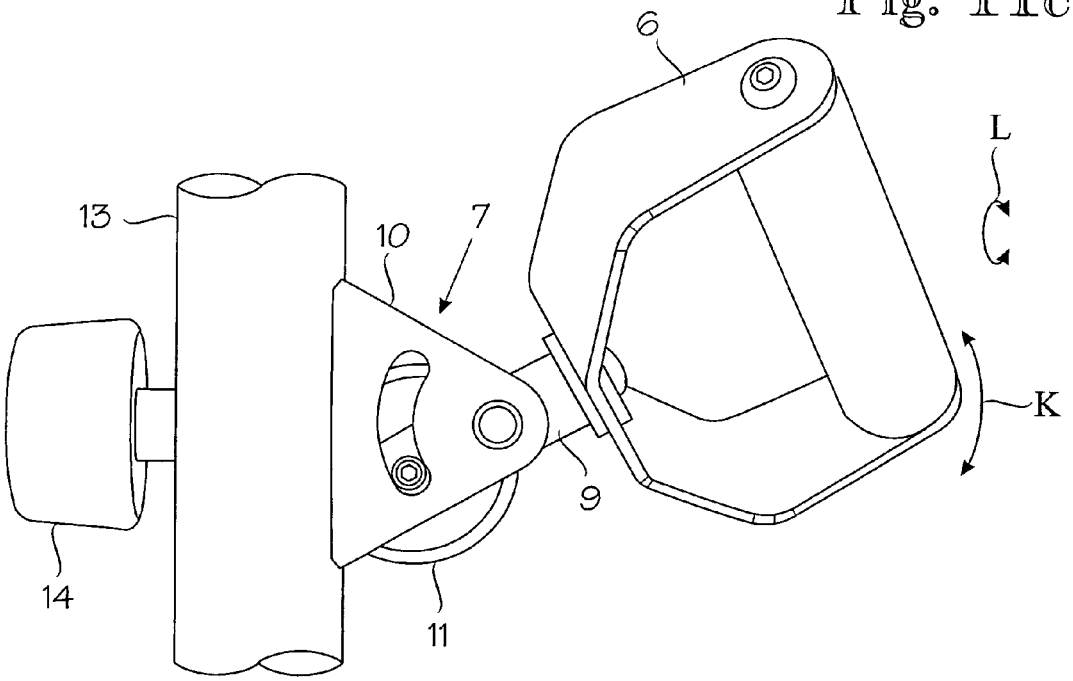

The invention will now be described in greater detail by means of embodiments illustrated in the drawings, in which FIG. 1 illustrates a prior art crosstrainer, FIGS. 2*a* and 2*b* schematically illustrate operation of an armrest of an exercise device according to an embodiment of the invention, FIGS. 3*a* and 3*b* schematically illustrate operation of an armrest of an exercise device according to a second embodiment of the invention, FIGS. 4*a* and 4*b* schematically illustrate operation of an armrest of an exercise device according to a third embodiment of the invention, FIGS. 5*a* and 5*b* schematically illustrate operation of an armrest of an exercise device according to a fourth embodiment of the invention, FIGS. 6, 7 and 8 schematically illustrate various embodiments of an armrest for an exercise device according to the invention that provide functions according to FIGS. 2*a* to 5*b*, FIGS. 9*a* and 9*b* schematically illustrate an additional feature of an exercise device armrest according to the invention, FIGS. 10*a* and 10*b* illustrate a technical solution of an embodiment of an exercise device armrest according to the invention, and FIGS. 11*a*, 11*b* and 11*c* illustrate optional operation of the embodiment according to FIGS. 10*a* and 10*b*.

FIG. 1 illustrates an example of a prior art crosstrainer. The device illustrated in FIG. 1 is available under product name Tunturi C60. In the Figure, reference number 1 denotes a frame structure of the device, reference number 2 a flywheel structure arranged to be supported by the frame structure, reference number 3 a footrest and reference number 4 armrests. There are two footrests 3 which are arranged on both sides of the flywheel structure and whose one end is pivoted to the flywheel structure. Armrests 4 made of elongated elements are pivoted to the other ends of the footrests 3. The armrests are also pivoted to the frame structure at point 5 in the longitudinal direction so that the movements of the flywheel, footrests and armrests are synchronized with one another. The device according to FIG. 1 further comprises a display and/or control panel 15 for adjusting the operation of the device, for example the flywheel resistance, in a desired manner and for monitoring exercise.

The structure and operation of the exercise device according to FIG. 1 are fully known to a person skilled in the art and will thus not be described in greater detail here.

As stated above, a disadvantage of the exercise device according to FIG. 1 is that it does not provide wide options for three-dimensional trajectories of the wrist and the whole upper body, in which case the effect of exercises is not optimal.

The object of the invention is to eliminate the above-mentioned drawback, which is achieved by the inventive concept. The basic idea of the invention is that the armrest 4 is provided with a separate moving handle 6 which is arranged to move in at least one direction with respect to the armrest during exercise. The separate handle 6 moving with respect to the armrest 4 enables adjustment of the handle in the vertical direction according to the user's height and thus an optimal trajectory for upper limbs and the whole upper body.

The above-mentioned inventive concept is clearly seen from FIGS. 3*a* and 3*b*. According to the basic idea of the invention, the handle 6 of the embodiment illustrated in FIGS. 3*a* and 3*b* may move away from or towards the armrest in the direction of an axis perpendicular to an axis in the longitudinal direction of the armrest 4. This movement is illustrated in FIGS. 3*a* and 3*b* by arrow M.

FIGS. 4*a* and 4*b* illustrate a second optional movement according to the basic idea of the invention where the handle 6 is arranged to move in a plane parallel with the longitudinal axis of the armrest 4. This movement is illustrated by arrow K in FIGS. 4*a* and 4*b*.

FIGS. 5*a* and 5*b* illustrate a third optional movement according to the basic idea of the invention where the handle 6 is arranged to rotate about an axis perpendicular to the longitudinal axis of the armrest 4. This movement is illustrated by arrow L in FIGS. 5*a* and 5*b*.

As described above, there are members 7 between the armrest 4 and the handle 6 or in connection with them that allow new degrees of freedom for the user's wrist. The members 7 allow wrist rotation with respect to the armrest. The members 7 also allow wrist extension and flexion as well as wrist adduction and abduction from the wrist's basic position. Whether wrist extension/flexion or wrist adduction/abduction takes place depends on the rotation position of wrist.

According to the invention, also the gripping point in the longitudinal direction of the armrest may be varied. To provide this additional function the handle 6 is further arranged to move in the longitudinal direction of the armrest 4, as shown in FIGS. 2*a* and 2*b*. The movement of the handle 6 is illustrated in FIGS. 2*a* and 2*b* by arrow N, i.e. the handle 6 may be moved up and down before the exercise according to the body measurements of the user and locked into a position by a suitable adjusting/locking member.

FIGS. 3*a* to 5*b* illustrate embodiments each of which enables one movement. According to the invention, these movements may naturally be combined. FIG. 6 illustrates an embodiment enabling three directions of movement. The members implementing these three directions of movement are schematically denoted by reference numbers 7*a*, 7*b* and 7*c*. In the example of FIG. 6, the members enabling different movements are implemented as separate members arranged one after the other. Naturally, the order of members 7*a*, 7*b* and 7*c* may be changed to achieve a desired feel of use.

FIG. 7 illustrates an embodiment also with three movement options as in the embodiment of FIG. 6. In the embodiment of FIG. 7, the member 7 is designed so that the single element enables all three movements, i.e. three separate elements 7*a*, 7*b* and 7*c* are replaced by one element enabling three movements.

FIG. 8 illustrates an embodiment of the invention where the member 7 consists of two elements, one allowing two movements and the other allowing one movement. The position of these elements may also be varied according to the need.

As regards the examples of FIGS. 6 to 8, it should be noted that these embodiments are only intended to describe different alternatives; the directions of movement may naturally be varied according to the need. For example, a structure enabling two separate movements may also be formed according to the principle illustrated in FIG. 6 or FIG. 7, etc. Naturally it is also possible to combine the embodiment of FIGS. 2*a* and 2*b* with embodiments according to any of FIGS. 3*a* to 8 and combinations thereof.

FIGS. 9*a* and 9*b* illustrate a further embodiment for improving the diversity of the solution according to the invention. In the embodiment of FIGS. 9*a* and 9*b*, the armrest 4 is provided with a joint 8 for bending the armrest 4 in the lateral direction, i.e. the armrest may be bent in a vertical plane perpendicular to the device's direction of use, which enables different gripping widths. This movement is illustrated in FIGS. 9*a* and 9*b* by arrow J. The embodiment of FIGS. 9*a* and 9*b* may be combined with embodiments according to FIGS. 2*a* to 8 and combinations thereof.

The joint 8 may be any prior art joint structure which enables the desired movement and is also lockable into a desired position.

The above examples are illustrated in schematic figures. FIGS. 10*a* and 10*b* as well as 11*a* to 11*c* illustrate an example of applying the inventive concept. In the example illustrated in the figures, the member 7 enabling rotation L and bending K of the handle 6 is implemented by a shaft member 9 and an intermediate piece 10 attached to it. In the example illustrated in the figures the intermediate piece 10 is attached to a sleeve-like part 13. The sleeve-like part 13 is to be slidingly arranged onto the armrest 4 according to the principle illustrated in FIGS. 2*a* and 2*b*. The sleeve-like part 13 may be locked to the armrest 4 at a desired height by means of a locking means 14, such as a screw means. Naturally other suitable means for the height adjustment of the armrest may also be used, such as a stepwise adjustment based on a pin and a locking hole. The handle 6 is rotationally fastened to the shaft member 9, and the shaft member 9 in turn is pivotally fastened to the intermediate piece 10. Further, the structure is provided with an adjusting/locking member 11, such as a friction-based screw member, as shown in the figures. However, alternative types of adjusting/locking member 11 may also be used, for example a pin and locking hole structure providing a stepwise action. FIGS. 10*a* and 10*b* illustrate rotation L of the handle 6 and FIGS. 11*a* and 11*b*, in turn, bending K of the handle 6. FIG. 11*c* shows a situation in which both movements L and K take place simultaneously. The adjustment/locking member 11 allows adjusting the magnitude of movement of the handle 6 and, if necessary, its locking into a desired position. The structure may also be provided with movement dampening elements 12, such as dampeners or springs which produce soft and comfortable movements. The above-mentioned dampening element 12 is illustrated schematically in FIG. 3*a*. It is clear that dampening elements and adjusting/locking members 11 may be arranged in all the elements 7 enabling different movements or in connection with them according to the need.

The embodiments of the invention described above are not intended to restrict the invention in any way but the invention may be modified freely within the scope of the claims. The handle 6 and the element 7 need not be separate elements but the handle 6 and the member 7 may also be formed as an integrated element, etc. Even though the invention was described above in connection with a crosstrainer, it is clear that the invention is not restricted in any way to such an exercise device. The invention is also applicable to other exercise devices, such as rowing devices.

The invention claimed is:

1. A crosstrainer, comprising:

a frame structure;

a flywheel structure supported by the frame structure;

a pair of footrests arranged on opposite sides of the flywheel structure and pivotably mounted to the flywheel structure; and a pair of handlebars pivotably mounted at a pivot point to the frame structure, each of the pair of handlebars comprising:

a first portion below the pivot point on the frame structure, said first portion being pivotably mounted to a respective one of the footrests; and a second portion above the pivot point on the frame structure, said second portion including a handle, said handle being movable in at least one direction with respect to the second portion of the handlebar, wherein the handle is movable in the at least one direction while the handlebar is pivoting during operation of the crosstrainer, wherein the handle further comprises a sleeve structure, the handle being mounted to the second portion of the handlebar through the sleeve structure at a mount point, said sleeve structure being slidable along a longitudinal direction of the second portion of the handlebar, and wherein the handle is arranged to rotate about an axis perpendicular to a longitudinal axis of the second portion of the handlebar and rotate with regard to the mount point in a plane parallel with the longitudinal direction of the second portion of the handlebar.

2. The crosstrainer according to claim 1, wherein the handle is arranged to move away from or towards the handlebar in the direction of an axis perpendicular to a longitudinal axis of the second portion of the handlebar.

3. The crosstrainer according to claim 1, wherein the handle is further arranged to move in a longitudinal direction of the second portion of the handlebar through the sleeve structure before operation of the crosstrainer.

4. The crosstrainer according to claim 1, wherein the handle is provided with a movement dampening element.

5. The crosstrainer according to claim 1, wherein the handle is provided with an adjusting/locking member which adjusts the magnitude of movement and/or locks the movement.

6. The crosstrainer according to claim 1, wherein the second portion of the handlebar further comprises a joint, a portion of the second portion of the handlebar above the joint being pivotably movable with regard to the joint in a lateral direction.

7. The crosstrainer according to claim 1, wherein the sleeve structure comprises a fixing member for fixing the handle to the second portion of the handlebar.

8. The crosstrainer according to claim 1, wherein the handle rotates about the axis perpendicular to the longitudinal axis of the second portion of the handlebar and rotates with regard to the mount point in a plane parallel with the longitudinal direction of the second portion of the handlebar, simultaneously during operation of the crosstrainer.

9. The crosstrainer according to claim 1, wherein the handle rotates about the axis perpendicular to the longitudinal axis of the second portion of the handlebar, rotates upwardly or downwardly with regard to the mount point in a plane parallel with the longitudinal direction of the second portion of the handlebar, and moves away from or towards the handlebar in the direction of an axis perpendicular to the longitudinal axis of the second portion of the handlebar, simultaneously.

* * * * *